US005604522A

United States Patent [19]

Miura et al.

[11] Patent Number: 5,604,522

[45] Date of Patent: Feb. 18, 1997

[54] INK JET HEAD AND A METHOD OF MANUFACTURING THE INK JET HEAD

[75] Inventors: Kazuhiko Miura; Toshio Narita, both of Nagano, Japan

[73] Assignee: Seiko Epson Corporation, Tokyo, Japan

[21] Appl. No.: 193,144

[22] PCT Filed: Jun. 11, 1993

[86] PCT No.: PCT/JP93/00788

§ 371 Date: Apr. 14, 1994

§ 102(e) Date: Apr. 14, 1994

[87] PCT Pub. No.: WO93/25390

PCT Pub. Date: Dec. 23, 1993

[30] Foreign Application Priority Data

| | | | |
|---|---|---|---|
| Jun. 11, 1992 | [JP] | Japan | 4-152402 |
| Nov. 9, 1992 | [JP] | Japan | 4-298858 |
| Jan. 27, 1993 | [JP] | Japan | 5-011973 |

[51] Int. Cl.[6] ..... B41J 2/045

[52] U.S. Cl. ..... 347/70; 29/890.1

[58] Field of Search ..... 347/68–72, 20; 29/890.1

[56] References Cited

U.S. PATENT DOCUMENTS

| | | | |
|---|---|---|---|
| 4,434,430 | 2/1984 | Koto | 347/70 |
| 4,468,680 | 8/1984 | Martner | 347/68 |
| 5,471,232 | 11/1995 | Hosono et al. | 347/70 |

FOREIGN PATENT DOCUMENTS

| | | | |
|---|---|---|---|
| 56-120365 | 9/1981 | Japan | 347/72 |
| 57-34975 | 2/1982 | Japan . | |
| 2-276649 | 11/1990 | Japan | 347/70 |
| 3-15555 | 1/1991 | Japan . | |
| 4-59254 | 2/1992 | Japan | 347/20 |

*Primary Examiner*—Huan H. Tran

*Attorney, Agent, or Firm*—Sughrue, Mion, Zinn, Macpeak & Seas

[57] ABSTRACT

An ink jet head for forcibly discharging ink droplets 6*a* through nozzle openings 13*a* in a manner that a pressure of ink 6 within an ink chamber 22 is increased by displacing a vibrating plate 20 constituting a part of the ink chamber 22 by a piezoelectric transducer 1, in which said vibrating plate 20 is formed of a high polymeric resin thin film 20*a* and rigid protrusions 20*b* directly fastened to said high polymeric resin thin film 20*b*.

17 Claims, 11 Drawing Sheets

INK JET HEAD AND A METHOD OF MANUFACTURING THE INK JET HEAD

FIELD OF THE INVENTION

The present invention relates to a recording head of an ink jet recording apparatus of the on-demand type which spouts forth ink droplets toward a recording medium, such as a recording paper, in accordance with a print signal, thereby forming an ink image on the recording paper, and a method of manufacturing the recording head, and more particularly to the construction of a island having vibrating film which forms one of the walls defining an ink chamber for discharging ink droplets and functions to transfer a vibration from a piezoelectric transducer to the ink chamber. The ink jet head of the present invention is suitable for image recording machines, such as copy machines, printers, and facsimile machines.

BACKGROUND TECHNIQUES

An ink jet head of the called on-demand type which spouts forth ink droplets in accordance with a print signal is categorized into two types according to the type of the ink discharging force generating means. The first type of the ink jet head is a called bubble jet type of the ink jet head in which a heater for instantaneously vaporizing ink is located at the nozzle tip, and ink droplets are generated and spouted forth by an expanding pressure when ink is vaporized. The second type of the ink jet head is constructed such that a part of an ink chamber forming an ink reservoir is constructed with a piezoelectric transducer which is deformed according to a print signal, and ink droplets are impelled to emit forward by a pressure generated in the ink chamber by the deformation of the piezoelectric transducer.

The on-demand type of the ink jet head as the second type of the ink jet head, as disclosed in Published Unexamined Japanese Patent Application Nos. Sho. 58-119870 and 58-119872, is constructed such that a vibrating film (called a diaphragm in both the publications) forming an ink chamber is coupled with a second end of a piezoelectric transducer fastened at a first end to a base, with an island-like protrusion (called a leg in both the publications) inserted therebetween. The expanding and contracting actions of the piezoelectric transducer cause the piezoelectric transducer to push the leg and to deform the vibrating film. The deformed film causes ink of the ink chamber to forcibly emit forward in the form of ink droplets through a nozzle opening.

Neither of the above-mentioned publications discloses any specific method of forming the vibrating film and the leg. The leg takes a complicated construction where it is fitted into a bearing. Therefore, it is very difficult to accurately manufacture and assemble the leg member and the bearing member for the purposes of size reduction and high density of packaging. To solve those problems, a first measure taken that is disclosed in Published Unexamined Japanese Patent Application No. Hei. 3-15555 is such that, as shown in FIG. 10, a vibrating film 61*a* (called a vibrating plate in the publication) made of silicon, 1.8 μm thick, and an island-like protrusion 61*b* (called a protrusion in the same publication) made of silicon oxide, 100 μm thick, are coupled together into a vibrating film 61 with a protrusion by the manufacturing technique of semiconductor elements, and the island-like protrusion 61*b* is brought into contact with a piezoelectric transducer 60.

In another measure taken by the publication, as a second measure, the island-like protrusion 61*b* is formed on the vibrating film 61*a*, 1 to 10 μm thick, made of metal, such as nickel, stainless steel, iron, copper, silver, gold, tantalum, or titanium, by an electroforming method, and the island-like protrusion 61*b* is brought into contact with the piezoelectric transducer 60.

In yet another measure taken by the publication, as a third measure, the island-like protrusion 61*b* of which the material and the method are not disclosed is fastened to the vibrating film 61*a* as an organic material film of 50 μm thick, and the island-like protrusion 61*b* is brought into contact with the piezoelectric transducer 60.

In a fourth measure taken by Published Unexamined Japanese Patent Application No. Hei. 3-190744, as shown in FIG. 11, a dummy layer, 100 μm thick, is formed on an electrode 71*c* of a piezoelectric transducer 70, and the resultant structure is cut by dicing process. The piezoelectric transducer 70 is separated, by the dicing, to form a dummy layer on a island-like protrusion 73*b*. A vibrating film 73*a* (called a cover member in the publication) of approximately 50 μm thick is bonded to the dummy layer island-like protrusion 73*b* by epoxy adhesive.

To realize a practical ink jet head by any of those conventional techniques, the following problems are created in addition to the difficulty of accurate manufacturing and assembly.

Firstly, the vibrating film 73, when formed of a high polymer resin of approximately 50 μm thick, cannot transfer pushing pressure and displacement that are high enough to discharge ink, to an ink chamber 75. Even if Pb-zirconatetitante that is considered, at present, to have the highest transducing efficiency is used for the piezoelectric material of the piezoelectric transducer 70, the displacement achieved is several μm or less. When a high polymeric resin film ten times or more as thick as the above displacement is used and it is pushed with the piezoelectric transducer 70, the displacement and pressure by pushing are absorbed by elastic deformation. Accordingly, it is not suitable for a recording head of a small size and high density of packaging. Secondly, vibrating film 61*a* formed of a silicon film or a metal foil is not resistive to the bending deformation. It will be fatigued and broken down. Therefore, it is not suitable for the displacement transfer member for the ink jet head which will repeat the deformation totally several hundred million times at high speed. Further, those materials are extremely high in rigidity. Because of this, they are not suitable as materials for the vibrating film which must be as flexible as possible.

With the view of solving the above problems, the present invention has an object to realize an ink jet head which is highly efficiently operable and to manufacture, at low cost, an ink jet head using a vibrating film with a protrusion, which enables the structure to be easily manufactured in a mass production manner.

DISCLOSURE OF THE INVENTION

An ink jet head for forcibly discharging ink droplets through nozzle openings in a manner that a pressure of ink within an ink chamber is increased by displacing a vibrating plate constituting a part of the ink chamber by a piezoelectric transducer, in which said vibrating plate is formed of a high polymeric resin thin film and rigid protrusions resin directly fastened to said high polymeric resin thin film. With such a construction, an expanding/contracting motion of the piezoelectric transducer is efficiently transferred to the ink chamber, enlarging a minute contact area of the piezoelectric transducer and amplifying the pushing force to the ink chamber. Therefore, an ink jet head which is reliable and excellent in the ink discharging characteristics is realized.

BEST MODES FOR EMBODYING THE INVENTION

The present invention will be described in detail with reference to the accompanying drawings.

In the present embodiment, two lines of nozzles each of 180 dpi (dot/inch) are arrayed so as to realize a printer of 360 dpi in resolution.

Figure 1:
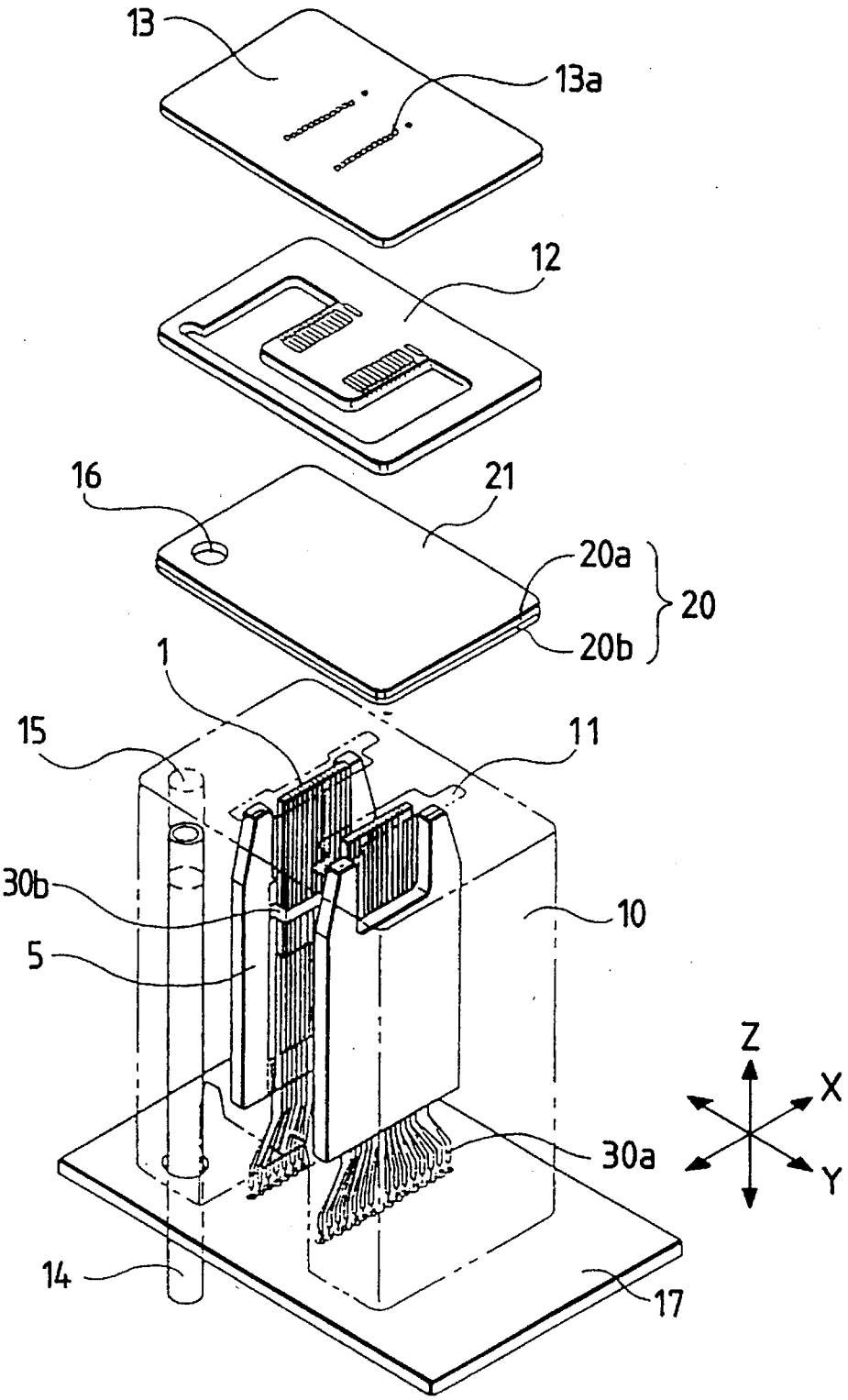
FIG. 1 is a perspective view showing the structure of an ink jet head to which an embodiment of the present invention is applied.

FIG. 1 is an exploded perspective view showing an example of an ink jet head to which the present embodiment is applied. As shown in FIG. 1, a mounting hole 11 passing through a head frame 10 supports a base member 5 to be given later in order to position it in X- and Y-axis directions. The top end face of the piezoelectric transducer 1 when longitudinally viewed is bonded to an island-like protrusion **20*b* as a rigid protruded part of a vibrating film 20 (referred to as an island-having vibrating film), whereby securing the positioning in the Z-axis direction. The island-having vibrating film 20, a flow path substrate 12, and a plate-like nozzle plate 13 having nozzle openings 13*a*** formed therein are laminated in this order to form a laminated structure.

Figure 2:
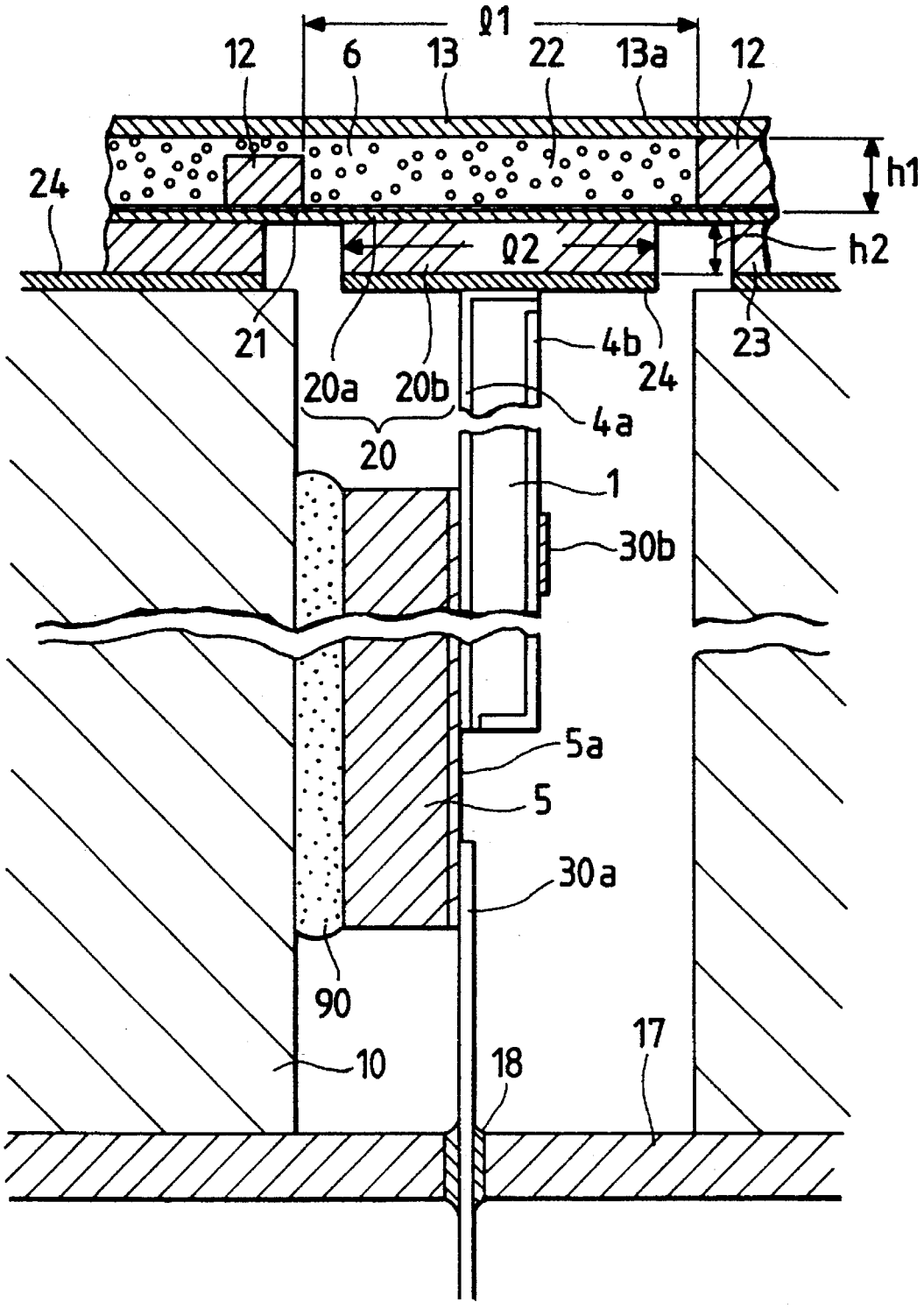
FIG. 2 is a cross sectional view showing a portion of the ink jet head to which an embodiment of the present invention is applied.

FIG. 2 is a cross sectional view showing a portion of the ink jet head to which an embodiment of the present invention is applied. An ink chamber 22 is formed of the nozzle plate 13 having nozzle openings **13*a* formed therein, the flow path substrate 12, and a vibrating film 20*a* as a high polymeric resin thin film of the island-having vibrating film 20**.

Figure 3A:
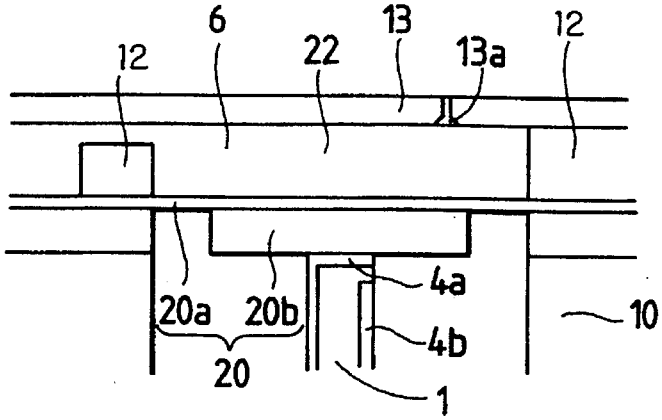
FIGS. 3A–3C are a set of diagrams showing an operation of the ink jet head of the invention.
Figure 3B:
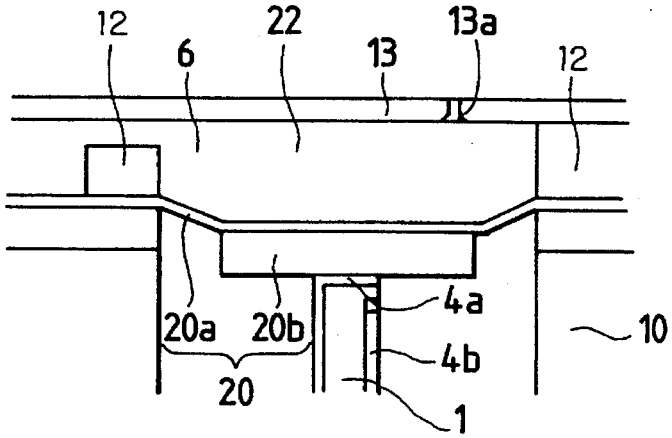
Figure 3C:
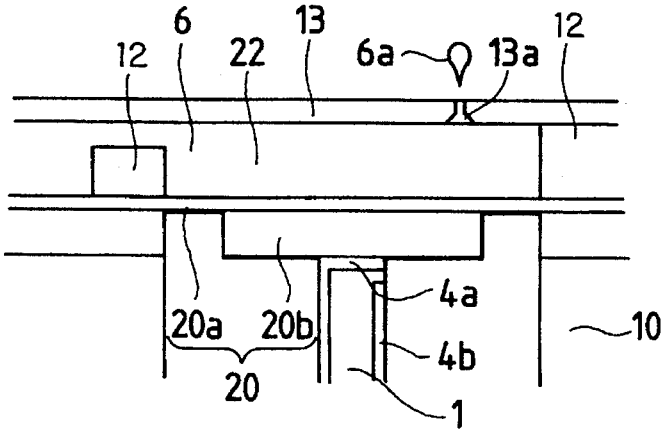

An ink reservoir, not shown, an ink supply pipe 14, an ink port 16, and the ink chamber 22 communicate with one another. Ink 6 is supplied from the ink reservoir (see FIG. 1). Reference numeral 23 designates a thick part of the island-having vibrating film, which is formed simultaneously with the island-like protrusion **20*b*. The piezoelectric transducer 1 is fastened at its base member 5 to the head frame 10 by means of adhesive 90. With such a structure, the principle of discharging ink droplets is as illustrated in FIGS. 3A–3C. An electrical connection for driving the piezoelectric transducer 1, net shown, is wired such that a drive signal is input to the transducer through first and second wiring boards 30*a* and 30*b*, a base electrode 5*a*, and first and second transducer electrodes 4*a* and 4*b*, as shown in FIG. 2. In a state of FIG. 3A, the piezoelectric transducer 1 is in a standby mode. As shown in FIG. 3B, when voltage is applied to the piezoelectric transducer 1, it contracts in the direction orthogonal to the nozzle plate 13 (Z-axis direction) , while pulling the island-having vibrating film 20 including the vibrating film 20*a* and the island-like protrusion 20*b*. When the electric field is removed, as shown in FIG. 3C, the resilient restoring force of the piezoelectric transducer 1 and the island-having vibrating film 20 increases the pressure of the ink 6 within the ink flow path 22, causing the ink chamber to forcibly discharge ink droplets 6*a* through the nozzle opening 13*a*. Then, the piezoelectric transducer 1** is set again in a standby mode.

The island-having vibrating film 20 receives the pushing force generated by the piezoelectric transducer 1 and functions mainly to provide a discharge of the largest possible ink droplet **6*a* (i.e., the weight or volume of the ink droplet). The largest possible ink droplet 6*a*** can be discharged when the following conditions are satisfied:

1) The vibrating film **20*a*** is as flexible as possible.

2) An area of the island-like protrusion **20*b* where it pushes the ink flow path 22** is set large.

3) The island-like protrusion **20*b*** is as rigid as possible.

With regard to the condition 1) above, μm is the lower limit of the film thickness in reducing the thickness of the vibrating film when considering a leakage of the ink 6 caused by defects of the vibrating film **20*a***, such as pin holes. If a film of high polymeric resin as a flexible material is used, it can be thinned up to this figure.

With regard to the condition 2), because of the demands for the size reduction and high density packaging of the ink jet head, there is a limit in enlarging the island-having vibrating film 20. To prevent an interference between the adjacent ink flow paths 22, it is necessary to set the area of the vibrating film **20*a* at a fixed value or more. This is one of the causes of limiting the enlargement of the size of the island-like protrusion 20*b***.

Therefore, the formation of the island-like protrusion **20*b* which is rigid as stated in the condition 3), that is, has a high rigidity, and is thick in the displacement direction is the best way to most effectively increase the volume or weight of the ink droplet 6*a***.

After the tests of many types of trial products, the inventor of the present Patent Application discovered the following fact. When adhesive, for example, is placed between the vibrating film **20*a* of high polymeric resin and the rigid island-like protrusion 20*b***, the separation between the vibrating film and the island-like protrusion takes place at the interface between them, considerably damaging the reliability. Further, because of the thickness of the adhesive, a transfer efficiency of the displacement fluctuates, making it very difficult to control a variation of the characteristics.

For this reason, it is advisable to directly fasten the vibrating film 20*a* to the island-like protrusion 20*b*.

Figure 4:
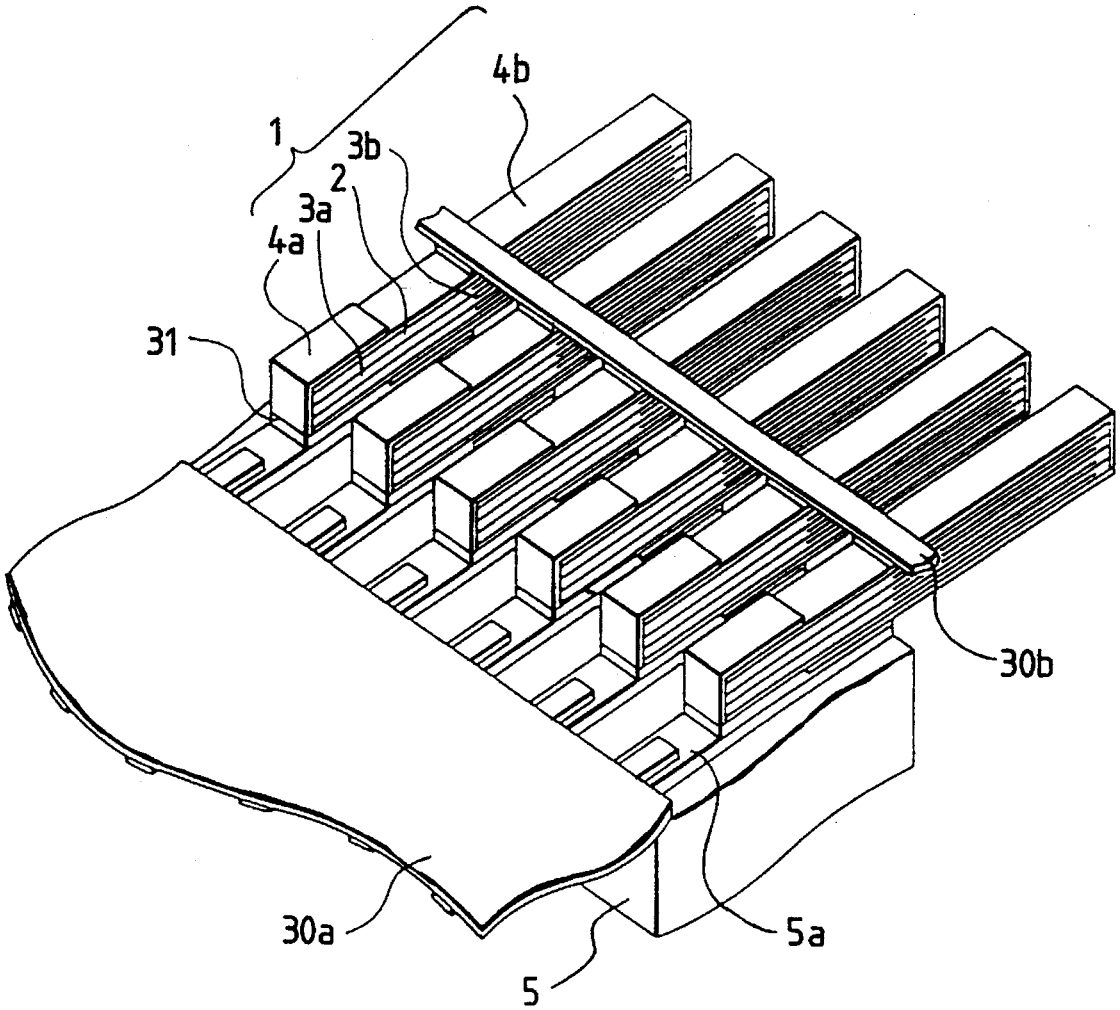
FIG. 4 is a cross sectional view showing a discharge pressure generating means of the ink jet head to which an embodiment of the present invention is applied.

FIG. 4 is a cross sectional view showing a discharge pressure generating means of the ink jet head to which an embodiment of the present invention is applied.

The pressure generating means includes the piezoelectric transducer 1 of a multi-layer structure in which a piezoelectric member 2 and conductive members 3*a* and 3*b* (referred to as internal electrodes 3*a* and 3*b*) are alternately layered. Conductive members 4*a* and 4*b*, which are respectively connected to the conductive members 3*a* and 3*b*, are further formed on the piezoelectric transducer 1. The first half of the piezoelectric transducer 1, as viewed longitudinally, is bonded to the base member 5 through a bonding means, while the end of the second half not bonded is bonded to the island-like protrusion 20*b* of the island-having vibrating film 20 (see FIG. 2).

The use of the thus constructed longitudinal mode vibrator can generate a higher pushing pressure than the use of the deflection vibrator. Use of the vibrator of the laminated type produces a large displacement at a low voltage applied. In this embodiment, the piezoelectric transducer 1 is designed to have the following dimensions: the width of each of an array of the piezoelectric transducers 1 when viewed in the array direction is 80 μm; the pitch of the array of the piezoelectric transducer 1 when viewed in the array direction is 141 μm; the thickness of the laminated structure when viewed in the lamination direction is approximately 0.5 mm; the lamination pitch in the lamination direction, i.e., the distance between the internal electrodes is approximately 20 μm; and the laminated structure length in the longitudinal direction is approximately 5 mm. When voltage of about 20 V is applied between the external electrodes 4*a* and 4*b* of the piezoelectric transducer 1 thus dimensioned, a displacement of 1 μm and 300,000 Pa. were obtained. As a result, ink of about 0.1 μm gram was discharged.

Figure 5:
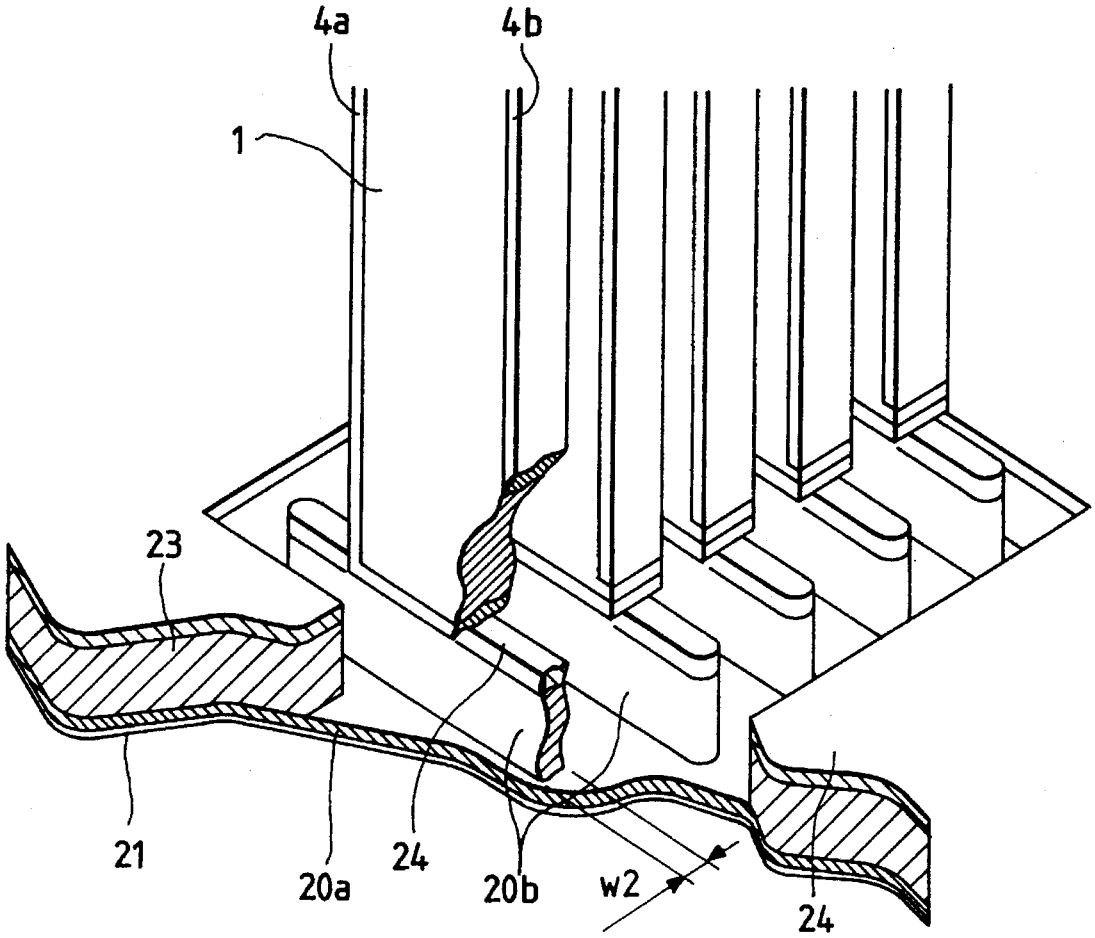
FIG. 5 is a perspective view, when viewed from the lower side, showing a key portion of the ink jet head to which an embodiment of the present invention is applied.

FIG. 5 is a perspective view, when viewed from the lower side, showing a key portion of the ink jet head to which an embodiment of the present invention is applied.

In the structure, the length (denoted as l1 in FIG. 2) of the ink chamber 22 is 1.5 mm; the height (h1 in FIG. 2) of the ink chamber 22 is 180 μm; the width of the ink chamber 22 is 100 μm; the thickness of the vibrating film 20*a* is 4 μm; the length (l2 in FIG. 2) of the protrusion 20*b* is 1.3 mm; the height (h2 in FIG. 2) of the protrusion 20*b* is 40 μm; and the width of the protrusion 20*b* is 30 μm.

A manufacturing method to realize the construction of the present invention will be described.

An embodiment of a first manufacturing process of the invention is illustrated in FIGS. 6A through 6I.

Figure 6A:
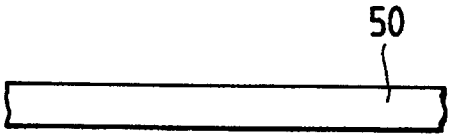
FIGS. 6A–6I are a set of diagrams showing a sequence of steps of a manufacturing process showing an embodiment of the present invention.

A plate material 50 of metal or ceramics, 0.01 to 1 mm thick, is prepared. A preferable material is any of copper, nickel, iron, stainless steel, silicon and the like since it is easy to work as will be seen later (FIG. 6A).

Figure 6B:
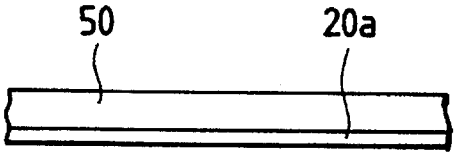

A high polymeric resin 20*a* is coated, 1 to 25 μm thick, entirely over one of the surfaces of the plate material 50 (FIG. 6B). Any of vacuum film forming process, e.g., vacuum vapor deposition, dip forming, roll coating, spray, and casting methods may be used for the film formation. The high polymeric resin 20*a* may be any of polyimide (PI) resin, polyether imide (PEI) resin, polyamide-imide (PAI) resin, poly-para-ban acid (PPA) resin, polysulfone (PSF) resin, polyether sulphone (PES) resin, polyether ketone (PEEK) resin, polyphenylene sulfate (PPS) resin, polyolefin (APO) resin, polyethylene-naphthalate (PEN) resin, alamide resin and the like. The film forming method must be chosen according to the material used. Of those film forming methods, the roll coating is preferable because it can easily form a smooth and uniform-thick film.

The high polymeric resin 20*a* as the vibrating film 20*a* as referred to above is preferably polyimide resin when considering its useful properties: high resistivity to etching liquid and resist removal liquid used in the etching process to be given later, high resistivity to the contents of the ink 6, adhesiveness developed by the resin per se, and excellent flexibility useful for the vibration film.

Figure 6C:
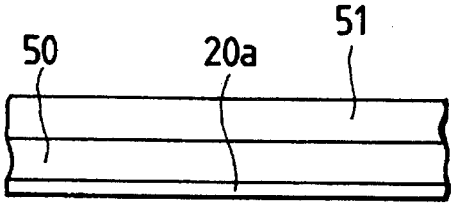

A photo sensitive resist 51 is formed on the other surface of the plate material 50 on which the high polymeric resin 20*a* is not formed (FIG. 6C).

Figure 6D:
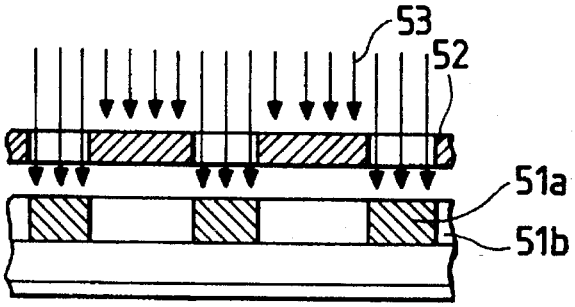
Figure 6E:
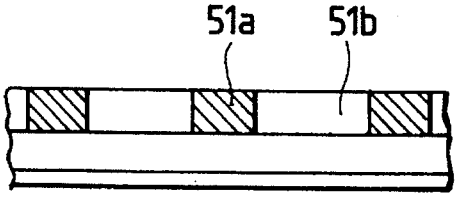

Using a photo sensitive mask 52, the formed photo resist 51 is irradiated with ultraviolet rays 53. to As a result, the photo sensitive resist 51 is selectively exposed to the ultraviolet rays (FIGS. 6D and 6E).

Figure 6F:
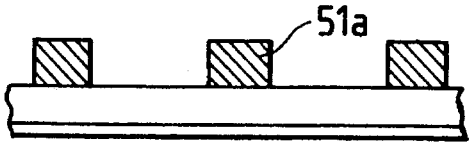

Then, the photo sensitive resist 51 is developed and exposed portions 51*a* are left (FIG. 6F).

Figure 6G:
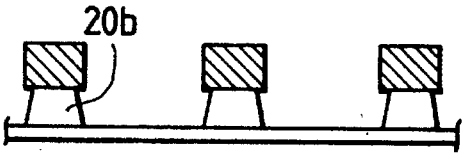

The plate material 50 is selectively subjected to a chemical etching process, using the photo sensitive resist 51. The remaining portions of the plate material 50 are formed as island-like protrusions 20*b* (FIG. 6G).

Figure 6H:
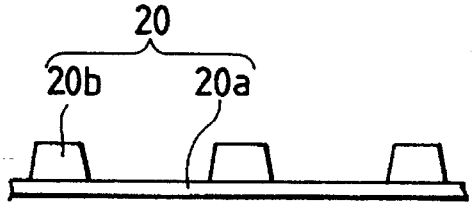

Subsequently, while leaving the exposed portions 51*a*, an island-having vibrating film 20 including island-like protrusions 20*b* and the high polymeric resin 20*a* and a thick part (designated by reference numeral 23 in FIG. 2) are formed (FIG. 6H).

Figure 6I:
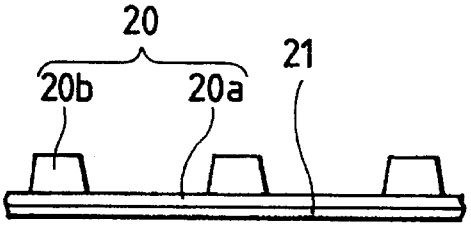

Finally, one of the surfaces of the island-having vibrating film 20 is entirely coated with an inorganic film 21 made of metal or ceramics. The inorganic film 21 may be formed on either surface of the island-having vibrating film 20. It is formed preferably on the surface of the vibrating film 20*a* on which the island-like protrusions 20*b* are formed, when considering the lessons for forming the inorganic film 21. The first advantage of forming the film is to prevent deterioration of the vibration characteristic of the piezoelectric transducer owing to the penetration of ink ingredients. The second purpose is to prevent deterioration of the vibrating film 20*a* owing to the spray of the ink 6 and a size variation of the film by the same cause. A preferable thickness of the inorganic film 21 is preferably 0.1 to 2 μm so as to secure the ink shielding function and the vibration characteristic of the piezoelectric transducer 1 (FIG. 6I). The inorganic film 21 is not always essential to the present invention. A swelling of the vibrating film 20*a* can be reduced to within a practically tolerable level by a proper choice and optimization of ink used. By hardening the resin film 20*a* in a state that an internal stress is generated in the coating direction, in the step (b) of the manufacturing process, a state as if the resin film 20*a* is attached to the thick part 23 while being tensioned is obtained, when it is completed as the island-having vibrating film 20. If so manufactured, an excessive dull is not formed in the vibrating film 20*a* if a slight swelling is caused in the film by the ink.

A sequence of steps of manufacturing process according to the second embodiment of the present invention is shown in FIGS. 7A through 7F.

Figure 7A:
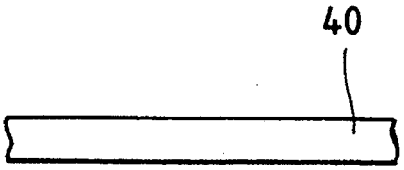
FIGS. 7A–7F are a set of diagrams of a manufacturing process showing an embodiment of a method of manufacturing the ink jet head of the present invention.

As shown in FIG. 7A, a plate member 40 is prepared. The plate member 40 becomes a series of first island-like protrusions 16*a* through a process to be given later.

Figure 7B:
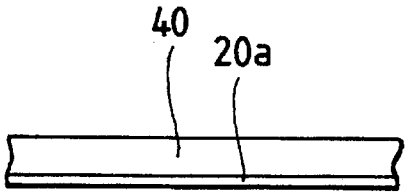

As shown in FIG. 7B, a precursor of high polymeric resin is laid on one of the surfaces of the plate member 40, and heat or light is applied to it to form a vibrating film 20*a*.

Figure 7C:
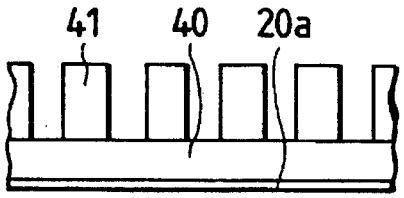

In the subsequent step of FIG. 7C, a photosensitive resist 41 is formed on the other surface of the plate member 40, and subjected to exposure or development process, thereby forming a desired pattern of the photosensitive resist.

Figure 7D:
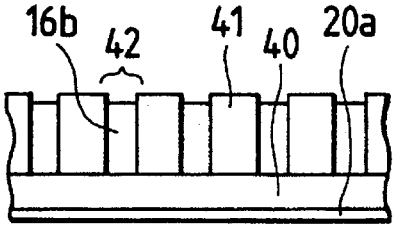

As shown in FIG. 7D, metal to serve as second island-like protrusions 16b is caused to deposit in the windows 42 of the plate member 40 bearing the patterned photosensitive resist 41.

Figure 7E:
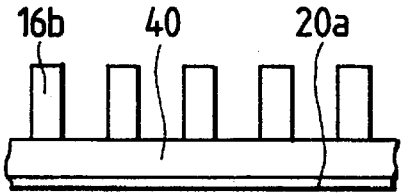

Then, as shown in FIG. 7E, the photosensitive resist 41 is removed.

Figure 7F:
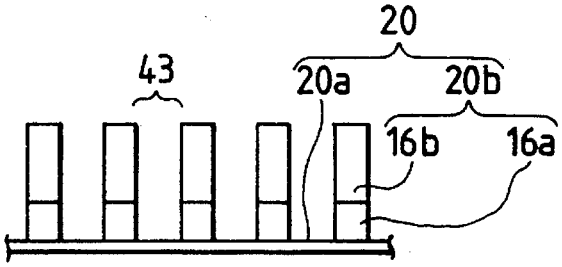

Finally, as shown in FIG. 7F, the photosensitive resist 41 is removed, windows 43 through which the plate member 40 is exposed are removed by a chemical etching process, for example. In the resultant structure, the first island-like protrusions 16a are formed under the second island-like protrusions 16b. This step completes the island-having vibrating film 20.

As shown in the above-mentioned manufacturing process, the deposited metal (second island-like protrusions 16b) already form part of the island-like protrusions 20b on the plate member 40. Thereafter, the plate member 40 as the lower layer is etched to form the first island-like protrusions 16a, thereby forming the island-having vibrating film 20. Accordingly, it is readily seen that the island-having vibrating film 20 can easily be formed.

Figure 8:
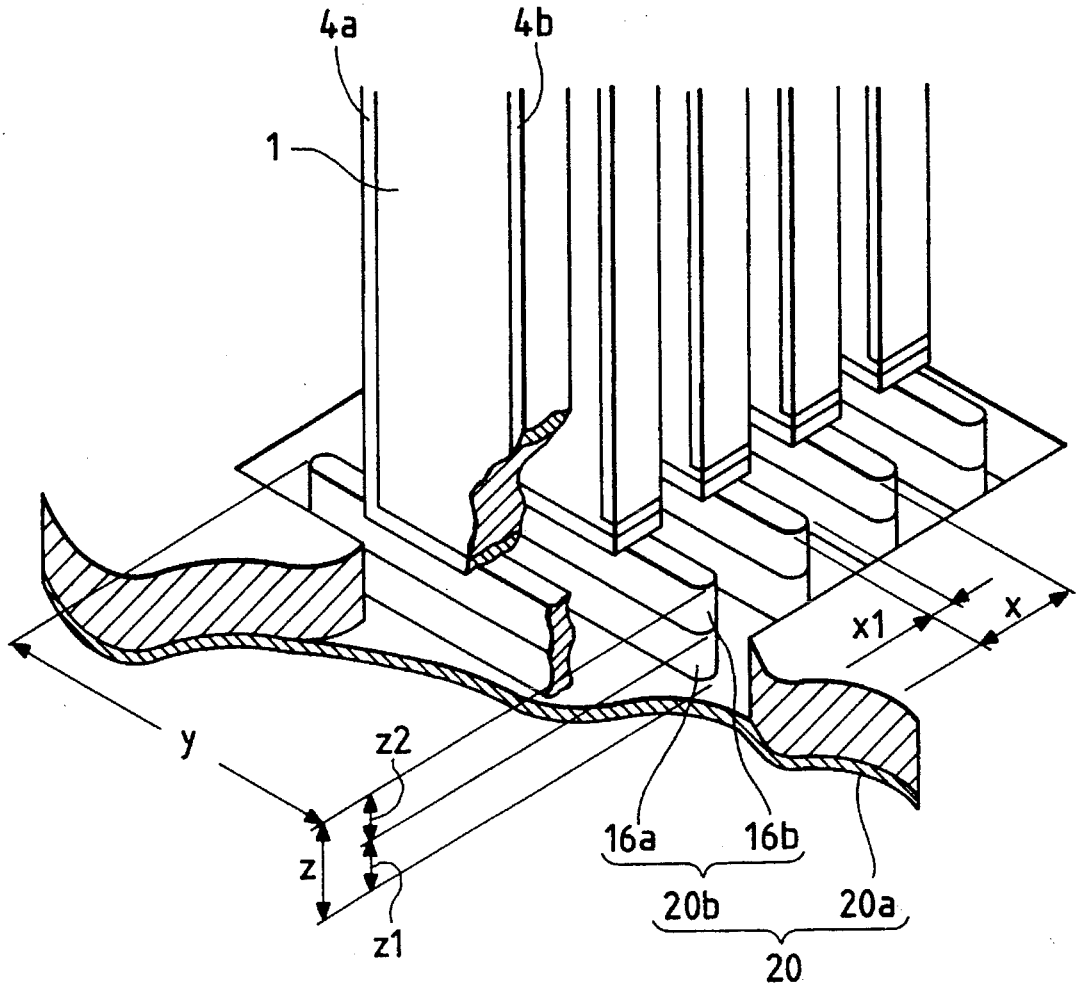
FIG. 8 is a perspective view showing a key portion showing an example of the ink jet head manufactured by the manufacturing method of the invention.

FIG. 8 is a perspective view showing a key portion of an example of the ink jet head manufactured by the manufacturing method of the invention. In the figure, there is illustrated an example of an island-having vibrating film 20 manufactured by the manufacturing process of this embodiment. The vibrating film 20a is made of polyimide, μm thick. A formation density x of the island-like protrusions 20b is 141.1 mm corresponding to 180 dpi. The width x1 of the island-like protrusion 20b is 30 μm. The length y thereof is 1.7 mm. With such dimensions, the first island-like protrusions 16a of z1 thick and the second island-like protrusions 16b of z2 thick can be formed by a beryllium copper foil of 50 μm thick and an electrotyped nickel film of 50 μm thick. Accordingly, the island-like protrusions 20b, which are formed by using the member which is inherently rigid and satisfactorily thick, is little deformed and has a high displacement transfer efficiency.

A sequence of steps of the manufacturing process according to the third embodiment of the present invention is shown in FIGS. 9A through 9F.

Figure 9A:
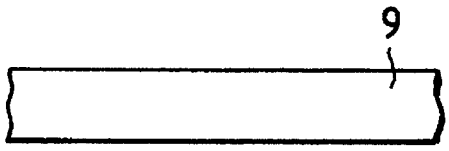
FIGS. 9A–9H are a set of diagrams of a manufacturing process showing another embodiment of a method of manufacturing the ink jet head of the present invention.

As shown in FIG. 9A, a plate member 9 is prepared. An embodiment, in which the plate member 9 is made preferably of material particularly of high corrosion proof such as copper, beryllium copper, titanium copper, phosphorus bronze, iron, or iron-nickel alloy, is now described as a suitable example of the present invention.

Figure 9B:
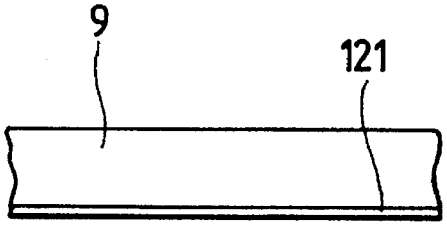

Then, as shown in FIG. 9B, a first inorganic thin film 121 is formed on one of the surfaces of the plate member 9. The film forming means may be any of the following methods: a vacuum film forming method, such as sputtering, vapor deposition, or CVD (chemical vapor deposition), a dip forming method by the first inorganic thin film 121 in a state of solution, a roll coating method, a spray method, and a plating method of depositing the first inorganic thin film 121. Metal of high sealing performance or ceramics is preferable of the first inorganic thin film 121. Accordingly, the vacuum film forming method or the plating method is preferable for the film forming method. In this embodiment, a film (first inorganic thin film 121) of nickel was formed by the plating method. Gold, chromium, palladium and platinum are available, in addition to the nickel.

The thickness of the first inorganic thin film 121 is preferably 0.1 to 20 μm in order to secure the dimensional accuracy of the island-like protrusion 20b by etching and to ensure the sealing of the plate member 9 in cooperation with a second inorganic thin film 122.

Figure 9C:
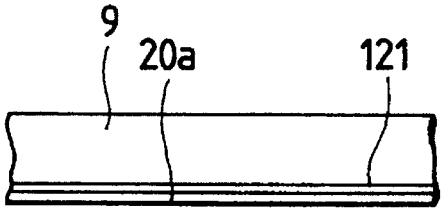

As shown in FIG. 9C, an vibrating film 20a is formed on either of the surfaces on which the first inorganic thin film 121 is formed. The vibrating film 20a, as described above, must have an inverse characteristic of that of the island-like protrusion 20b, and be as thin as possible and flexible, in order to efficiently transfer the pushing force of the piezoelectric transducer 1. This embodiment also uses polyimide as in the previous embodiment.

Figure 9D:
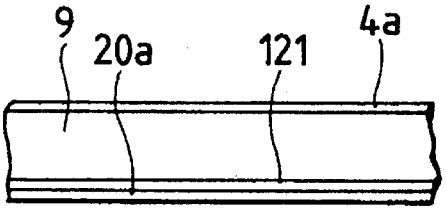
Figure 9E:
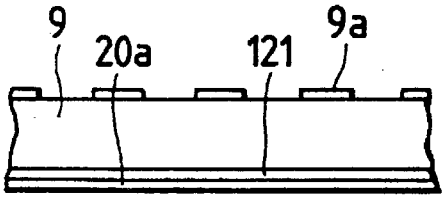

As shown in FIGS. 9D and 9E, a photosensitive resist film 9a is formed on the other surface of the plate member 9. It is patterned by the exposure and developing process. In this embodiment, the formation density of the photosensitive resist film 9a is 141.1 μm pitch corresponding to 180 dpi.

Figure 9F:
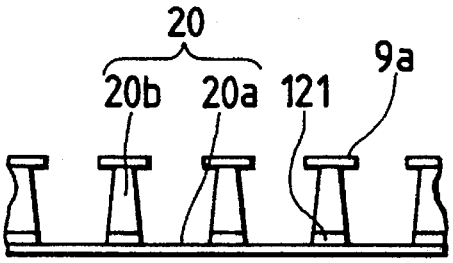

As shown in FIG. 9F, the plate member 9 is selectively removed by such means as chemical etching. Subsequently, the first inorganic thin film 121 is selectively removed similarly by chemical etching, plasma or ion etching process.

Figure 9G:
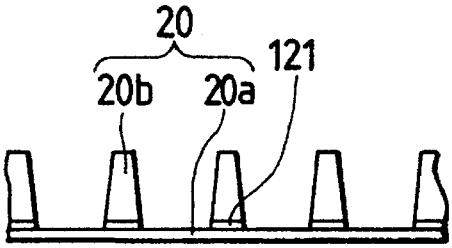

In the next step, as shown in FIG. 9G, the photosensitive resist film 9a is removed.

Figure 9H:
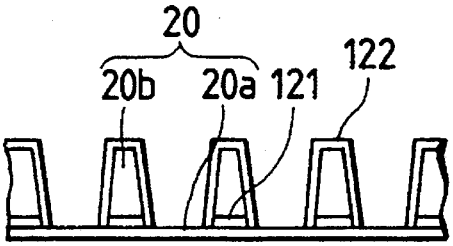
Figure 10:
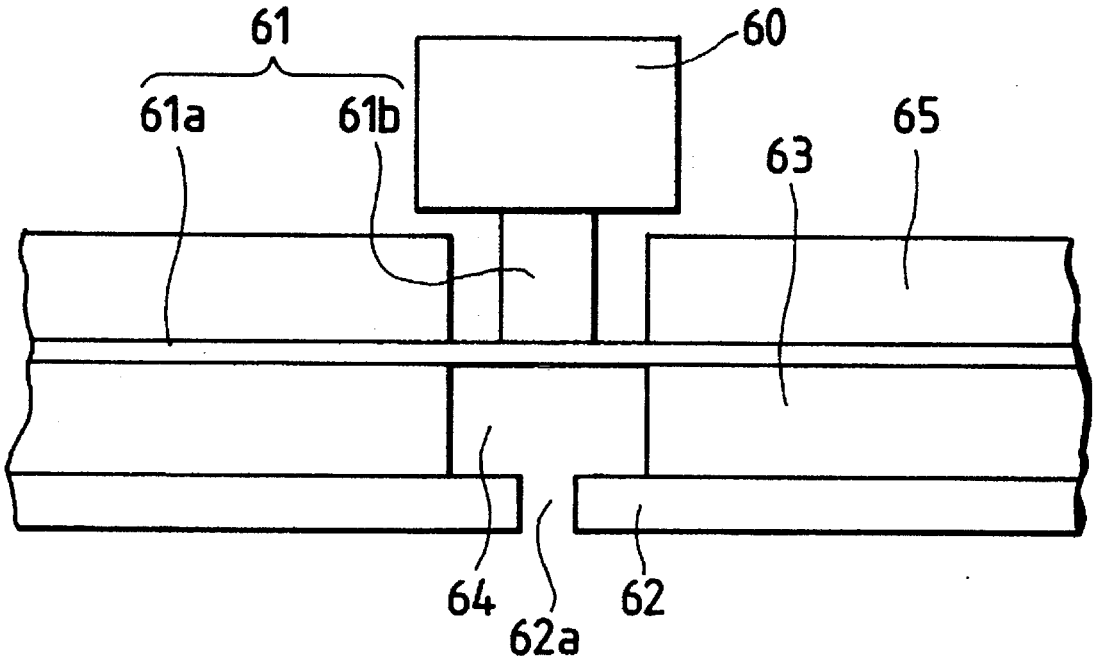
FIG. 10 is a diagram showing a prior art.
Figure 11:
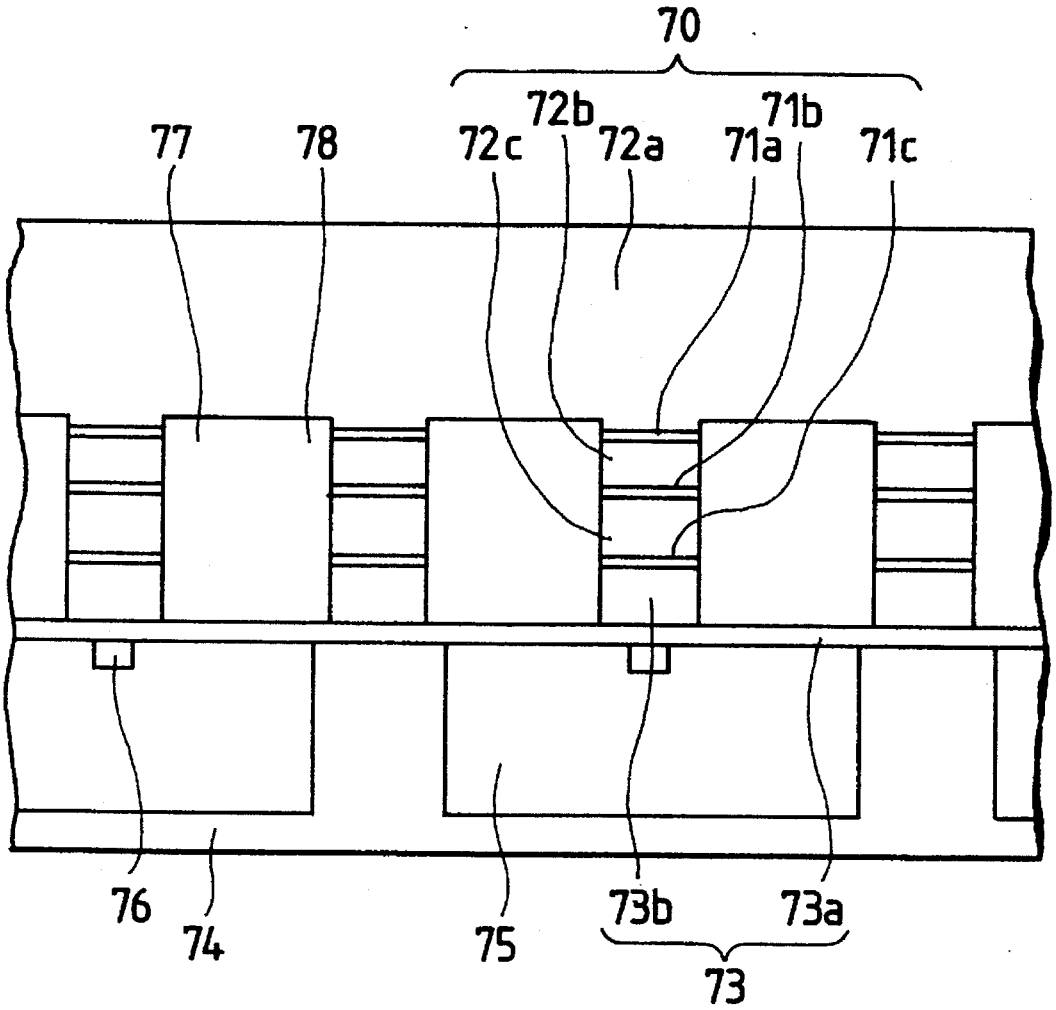
FIG. 11 is a diagram showing another prior art.

In the final step, as shown in FIG. 9H, a second inorganic thin film 122 is formed on the surface of the island-like protrusions 20b, and the island-like protrusions 20b are sealed in every direction. The best film forming means is a nonelectrolysis plating method which can selectively form only the island-like protrusions 20b. In this embodiment, nickel is used for the second inorganic thin film 122 as for the first inorganic thin film 121. In addition to nickel, gold, chromium, palladium and platinum are preferable.

The thickness of the second inorganic thin film 122 is preferably 0.1 μm or more, more preferably 20 μm.

Through the process steps, the island-having vibrating film 20 is formed. With such a construction, even if ink ingredients penetrate through the vibrating film 20a, for example, the corrosion proof of the island-like protrusion 20b is secured, ensuring the reliability of the ink jet head for a long time. Further, material that has such a high corrosion proof as to satisfy the ink discharge performance, and allows a fine work easily and conversely has a low reliability in view of a high corrosiveness thereof, may be used for the island-like protrusion 20b. Therefore, both the reliability and the ink discharge performance can be satisfactorily secured.

In the ink jet head manufactured according to the construction and the method of the invention, the discharged ink droplet 6a is increased in weight by 15%, and a high efficiency of pushing force transfer is obtained.

As described, the island-having vibrating film is constructed such that the thick island-like protrusion of high rigidity is directly fastened to the very thin vibrating film of high polymeric resin, improving the ink discharging characteristic. Since such a structure is easily and accurately manufactured, a low cost and a high quality of the resultant head of the ink jet head are achieved.

Further, since an insulating material may be used for the vibrating film, the island-like protrusions, if it is made of metal of high rigidity, can easily be insulated from the drive electrodes exposed to the vibrator surface.

We claim:

1. An ink jet head for forcibly discharging ink droplets, comprising:

an ink chamber having nozzle openings through which said ink droplets are forcibly discharged, a vibrating plate having a first and a second surface and formed of a high polymeric resin thin film with rigid protrusions on one of said surfaces, said vibrating plate constituting a part of the ink chamber, and a piezoelectric transducer directly contacting said protrusions and moving said vibrating plate to increase the pressure in said ink chamber and forcibly discharge said ink droplets.

2. The ink jet head according to claim 1, in which an inorganic thin film is formed on either of said surfaces of said vibrating plate.

3. The ink jet head according to claim 1, in which an inorganic film is formed between said rigid protrusions and said high polymeric resin thin film.

4. The ink jet head according to claim 1, in which said vibrating plate includes a thick part enclosing said rigid protrusions and is contained in the same layer as of said rigid protrusions, wherein said resin thin film is attached to said thick part while said resin thin film is kept taut.

5. The ink jet head according to claim 1, in which said high polymeric resin thin film is made of polyimide.

6. The ink jet head according to claim 1, in which a major component of said rigid protrusions is any of stainless steel, nickel, and beryllium copper.

7. The ink jet head according to claim 1, in which said piezoelectric transducer comprises a longitudinally vibrating piezoelectric vibrator.

8. The ink jet head according to claim 1, in which said piezoelectric transducer comprises alternately layered piezoelectric members and conducting members.

9. A method of manufacturing an ink jet head for forcibly discharging ink droplets comprising the steps of:

providing an ink chamber having nozzle openings through which said ink droplets are forcibly discharged, providing a vibrating plate having a first and a second surface and constituting a part of the ink chamber, said vibrating plate including a one-piece construction of a high polymeric resin film and rigid protrusions formed by the steps of:

providing an inorganic plate material having a first and a second surface, forming a high polymeric resin film on either of the surfaces of said inorganic plate material, and selectively removing portions of said plate material.

10. The manufacturing method according to claim 9, further comprising the step of forming an inorganic film on either of the surfaces of said vibrating plate.

11. The manufacturing method according to claim 9, wherein said step of forming a high polymeric resin film further comprises the step of: generating a stress in the high polymeric resin to keep said high polymeric resin taut.

12. The manufacturing method according to claim 9, in which a major component of said rigid protrusions is either of stainless steel and nickel.

13. The manufacturing method according to claim 9, in which said high polymeric resin thin film is made of polyimide.

14. A method of manufacturing an ink jet head for forcibly discharging ink droplets comprising the steps of providing an ink chamber having nozzle openings through which said ink droplets are forcibly discharged;

providing a vibrating film constituting a part of the ink chamber by:

forming a high polymeric resin film on either of the surfaces of a plate member, selectively depositing second rigid protrusions on the other surface of said plate member, and selectively removing said plate member and forming first rigid protrusions; and providing a piezoelectric transducer in the vicinity of said vibrating film to displace said vibrating film and increase the pressure within said ink chamber.

15. The manufacturing method according to claim 14, in which said rigid protrusions contain beryllium copper as a major component.

16. The manufacturing method according to claim 14, in which said high polymeric resin thin film is made of polyimide.

17. The ink jet head according to claim 8, wherein said conducting members are provided with a first conducting layer connecting to a first external electrode and a second conducting layer connecting to a second external electrode, and said piezoelectric member is disposed between said first and second conducting layers which are alternately layered in said array.

* * * * *